US011715432B2

(12) United States Patent
Xiong et al.

(10) Patent No.: US 11,715,432 B2
(45) Date of Patent: Aug. 1, 2023

(54) DRIVING METHOD OF BACKLIGHT MODULE AND DISPLAY DEVICE

(71) Applicant: HKC Corporation Limited, Shenzhen (CN)

(72) Inventors: Zhi Xiong, Shenzhen (CN); Haoxuan Zheng, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/847,193

(22) Filed: Jun. 23, 2022

(65) Prior Publication Data

US 2022/0415272 A1 Dec. 29, 2022

(30) Foreign Application Priority Data

Jun. 23, 2021 (CN) ..... 202110698395.7

(51) Int. Cl.
*G09G 3/34* (2006.01)
*G09G 3/20* (2006.01)

(52) U.S. Cl.
CPC ..... *G09G 3/3426* (2013.01); *G09G 3/2092* (2013.01); *G09G 2320/0626* (2013.01)

(58) Field of Classification Search
CPC ..... G09G 3/3426; G09G 2320/0626
See application file for complete search history.

(56) References Cited

U.S. PATENT DOCUMENTS 8,427,419 B2 * 4/2013 Ahn ..... G09G 3/3426 362/97.1
8,432,352 B2 * 4/2013 Lee ..... G09G 3/3426 345/102
8,482,507 B2 * 7/2013 Han ..... G09G 3/3426 362/617
8,531,384 B2 * 9/2013 Kwon ..... G09G 3/3426 345/102
8,531,385 B2 * 9/2013 Kim ..... G09G 3/3426 345/102
8,576,159 B2 * 11/2013 Cho ..... G09G 3/3426 345/102
8,670,006 B2 * 3/2014 Hong ..... G09G 3/3426 345/207
8,760,385 B2 * 6/2014 Kwon ..... G09G 3/3426 345/102

(Continued)

FOREIGN PATENT DOCUMENTS

CN 109192149 A 1/2019
TW 201947573 A 12/2019

*Primary Examiner* — Gene W Lee

(57) ABSTRACT

A driving method for a backlight module and a display device are disclosed. The driving method includes: generating mapping information from each local dimming area to the corresponding piece of local area dimming data according to preset positional relationships between a backlight driving chip and lamp beads in the backlight module; receiving, by a timing control chip, a frame of display data, and converting the display data into panel driving data and corresponding multiple pieces of local area dimming data; receiving, by a backlight driving circuit, the multiple pieces of local area dimming data in sequence, turning on the channel corresponding to the current local dimming area in turn according to the mapping information, and driving the lamp beads in the current local dimming area.

16 Claims, 4 Drawing Sheets

(56) References Cited

U.S. PATENT DOCUMENTS

| | | | | |
|---|---|---|---|---|
| 8,890,900 | B2 * | 11/2014 | Kwon | G09G 3/3648 315/169.3 |
| 9,087,485 | B2 * | 7/2015 | Ahn | G09G 3/3426 |
| 9,202,419 | B2 * | 12/2015 | Kim | G09G 3/3406 |
| 9,613,409 | B1 * | 4/2017 | Tsai | G09G 3/3406 |
| 11,244,636 | B2 * | 2/2022 | Shi | G09G 3/3426 |
| 11,303,842 | B2 * | 4/2022 | Zhou | H05B 45/347 |
| 11,468,866 | B2 * | 10/2022 | Ide | G09G 3/32 |
| 2011/0141004 | A1 * | 6/2011 | Kwon | G09G 3/3426 345/102 |
| 2011/0148940 | A1 * | 6/2011 | Byun | G09G 3/3426 345/102 |
| 2020/0382740 | A1 * | 12/2020 | Zhou | H04N 5/63 |

* cited by examiner

DRIVING METHOD OF BACKLIGHT MODULE AND DISPLAY DEVICE

CROSS-REFERENCE TO RELATED APPLICATIONS

This application claims the priority and benefit of Chinese patent application 2021106983957, entitled "Driving Method of Backlight Module, and Display Device" and filed Jun. 23, 2021, with China National Intellectual Property Administration, the entire contents of which are incorporated herein by reference.

TECHNICAL FIELD

This application relates to the field of display technology, and more particularly relates to a driving method of a backlight module and a display device.

BACKGROUND

As the requirements for image quality are getting higher and higher, traditional backlighting or dimming solutions with small number of partitions can no longer meet the demand. In order to improve the display effect, more and more mini LED (mini light emitting diode) or Micro LED (micro light emitting diode) backlight solutions and even display solutions have been proposed, whose quasi-pixel-level dimming can greatly improve the display effect of the panel, and can achieve extremely low brightness at low grayscales and extremely high brightness at high grayscales, making the display effect close to or even surpassing organic light-emitting (OLED) displays in some indicators.

The driving of mini LED display device and general direct-lit type LCD (Liquid Crystal Display) device includes the driving of display panel and the driving of backlight module. When the display device is turned on, the display data (input data) is first input into the timing control chip (TCON), which converts the display data, and at the same time inputs the converted signal to the source driving chip and the backlight driving chip (LED Driver) of the display device, thus achieving the driving of the display panel and the driving of the lamp beads at the same time. However, because the delay between the backlight driving of the backlight module and the display driving of the display panel is too long, the image is delayed and the display effect is affected.

SUMMARY

It is therefore a purpose of the present application to provide a driving method for a backlight module and a display device, which can reduce the delay between the backlight driving of the backlight module and the display driving of the display panel, thus improving the display effect of the display device.

The application discloses a driving method of a backlight module, including:

generating the mapping information from a local dimming area to a corresponding piece of local area dimming data based on a preset positional relationship between a backlight driving chip and a plurality of lamp beads in the backlight module;

receiving, by the timing control chip, a frame of display data, and converting the display data into a plurality of pieces of panel driving data and a plurality of pieces of local area dimming data corresponding to the plurality of pieces of panel driving data; and receiving, by the backlight driving circuit, the plurality of pieces of local area dimming data in sequence, sequentially turning on the channel corresponding to the current local dimming area according to the mapping information, and driving the lamp beads in the current local dimming area.

The application further discloses a display device, including a plurality of lamp beads, a backlight driving circuit, a timing control chip and a mapper. The plurality of the lamp beads are divided into a plurality of local dimming areas. The lamp beads in each local dimming area are connected with the backlight driving circuit through a channel. The timing control chip receives a frame of display data and converts the display data into a plurality of pieces of panel driving data and a plurality of pieces of local area dimming data corresponding to the plurality of pieces of panel driving data. Each piece of local area dimming data is in one-to-one correspondence with each local dimming area. The mapper is arranged in the backlight driving circuit, and generates mapping information from each of the local dimming areas to the corresponding piece of local area dimming data according to the preset positional relationships between the backlight driving chip and the lamp beads. The backlight driving circuit receives the plurality of pieces of local area dimming data in sequence, and sequentially turns on the channel corresponding to the current local dimming area according to the mapping information recorded in the mapper to drive the lamp beads in the current local dimming area.

The present application provides a driving method for a backlight module, so that when receiving local area dimming data, the backlight driving circuit will drive the lamp beads corresponding to the local dimming area according to the mapping information. In this way, the backlight driving circuit does not need to first receive all the area dimming data in a frame, and then rearrange the driving signals corresponding to the local area dimming data according to the preset positional relationships between the backlight driving chip and the lamp beads in the backlight module, before then driving the lamp beads. By adopting the technical solution in the present application, the step of rearranging the local area dimming data is omitted, thereby saving the time for driving the lamp beads and reducing the delay between the backlight driving of the backlight module in the display device and the display driving of the panel time to improve the display effect of the display device.

BRIEF DESCRIPTION OF DRAWINGS

The accompanying drawings, which are included to provide a further understanding of the embodiments of the present application, constitute a part of the specification, are used to illustrate the embodiments of the present application, and together with the written description, serve to explain the principles of the present application. Obviously, the drawings used in the following description merely depict some embodiments of the present application, and for those having ordinary skill in the art, other drawings can also be obtained from these drawings without investing creative effort. In the drawings.

DETAILED DESCRIPTION OF EMBODIMENTS

Figure 1:
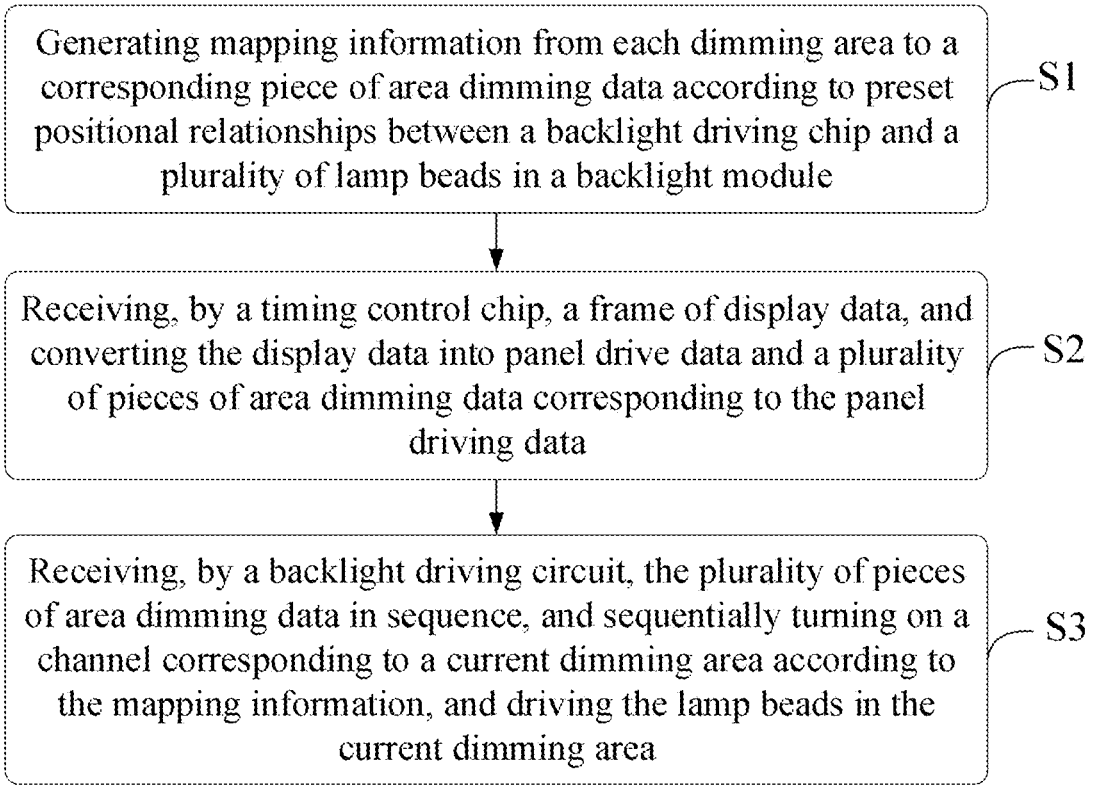
FIG. 1 is a flowchart illustrating a driving method of a backlight module provided by a first embodiment of the present application.

It should be understood that the terminology used herein, the specific structural and functional details disclosed are intended for the mere purpose of describing specific embodiments and are representative, but the present application may be embodied in many alternative forms and should not be construed as limited only the embodiments set forth herein.

In the description of this application, the terms "first" and "second" are merely used for description purposes, and cannot be understood as indicating relative importance, or implicitly indicating the number of indicated technical features. Thus, unless otherwise specified, features defined as "first" and "second" may expressly or implicitly include one or more of the features; "plurality" means two or more. The terms "including", "comprising", and any variations thereof are intended to mean a non-exclusive inclusion, namely one or more other features, integers, steps, operations, units, components and/or combinations thereof may be present or added.

In addition, terms such as "center", "transverse", "lateral", "above", "on", "under", "below", "left", "right", "vertical", "horizontal", "top", "bottom", "inside", "outside", etc., indicative of orientations or positional relationships are described based on the orientations or relative positional relationships illustrated in the drawings, and are intended for the mere purpose of convenience of simplified description of the present application, rather than indicating that the device or element referred to must have a specific orientation or be constructed, and operate in a particular orientation. Thus, these terms should not be construed as limiting the present application.

In addition, unless otherwise expressly specified and defined, terms "installed on", "connected to", and "coupled to" should be understood in a broad sense. For example, it may be a fixed connection, a detachable connection, or an integral connection; it may be a mechanical connection, or may also be an electrical connection; it may be a direct connection, an indirect connection through an intermediate medium, or an internal connection between two components. For those having ordinary skill in the art, the specific meanings of the above terms in this application can be understood depending on specific contexts.

The present application will be described in detail below with reference to the accompanying drawings and optional embodiments.

Embodiment 1

FIG. 1 is a schematic flowchart illustrating a method for generating a common voltage look-up table according to the first embodiment of the present application. The driving method of the backlight module includes the following operations:

S1: generating the mapping information of a local dimming area to a corresponding piece of local area dimming data based on a preset positional relationship between a backlight driving chip and multiple lamp bead in the backlight module;

S2: receiving, by the timing control chip, a frame of display data, and converting the display data into a plurality of pieces of panel driving data and a plurality of pieces of local area dimming data corresponding to the plurality of pieces of panel driving data; and S3: receiving, by the backlight driving circuit, the plurality of pieces of local area dimming data in sequence, sequentially turning on the channel corresponding to the current local dimming area according to the mapping information, and driving the lamp beads in the current local dimming area.

The backlight module driving method of the present application is suitable for a mini LED (mini light emitting diode) display device, and is also suitable for a direct type LCD display device. Compared with the current solution in which the backlight driving circuit first receives all the local area dimming data in a frame of image, and then rearranges the driving signals corresponding to the local area dimming data according to the preset positional relationships between the backlight driving chip and the lamp beads in the backlight module, and then drives the lamp beads in turn, the present application provides the following advantages. By using the backlight module driving method provided by the present application, when receiving the local area dimming data, the backlight driving circuit can drive the lamp beads corresponding to the local dimming area according to the mapping information, thereby eliminating the need for rearranging the local area dimming data, saving the time for driving the lamp beads, reducing the delay time between the backlight driving of the backlight module and the display driving of the panel in the display device, and improving the display effect of the display device. Furthermore, since the present application does not need to rearrange the driving signals corresponding to the local area dimming data, the data operations in the backlight driving circuit are greatly reduced, and the operation efficiency of the backlight driving circuit can be improved.

For example, currently the display data (input data) received by the timing control chip (TCON IC) is input in sequence from left to right and from top to bottom row by row. The multiple pieces of local dimming data (Local Diming Data) output after the internal logic operation of the timing control chip are also arranged in order from left to right and from top to bottom. If not processed by the backlight driving circuit, the drive signals output to the lamp beads are also arranged in order from left to right and from top to bottom. However, due to the different applications and different layouts of lamp bead driving schemes, the corresponding driving signals need to be adjusted according to different applications. The current solution is to first rearrange the driving signals output to the lamp beads in the backlight driving circuit depending on the different lamp bead drive schemes. As such, the backlight driving circuit needs to wait for all the pieces of local area dimming data in a frame to be received and then start the rearrangement of the data. As a result, there is a long delay between when the timing control chip receives the display data and when the lamp bead receives the driving signal, resulting in a long delay time between the backlight driving and the display driving.

The present application modifies the internal logic in the backlight driving circuit so that the signals it receives and outputs are no longer fixed channels, so that the order of signals or data does not need to be adjusted. That is, the display data received by the timing control chip is input in order from left to right and from top to bottom row by row, and the multiple pieces of local area dimming data output after the internal logic operation of the timing control chip are also ordered from left to right and from top to bottom. Furthermore, the driving signals sent to the lamp beads ae also arranged in order from left to right and from top to bottom, so as to achieve the effect of eliminating the need to rearrange the order of signals or data.

Specifically, in operation S1, the mapping information reflects the positional relationships between the backlight driving chip and the lamp beads in the backlight module, that is, when the lamp bead driving scheme is applied and laid out in a specific application, its corresponding driving signal needs to be adjusted accordingly according to this application. In the design process of the display device, the mapping information can be written into the timing control chip or the backlight driving circuit. The mapping information can be in the form as a chart, a code, or a mini program or applet, which is not limited here. The local dimming area may be an area with the same brightness in the display screen, or may be an area corresponding to one pixel or one lamp bead.

In step S2, after generating one piece of local area dimming data, the timing control chip directly sends the current piece of local area dimming data to the backlight driving circuit, and generates the next piece of local area dimming data. Correspondingly, in step S3, after receiving the current piece of local area dimming data, the backlight driving chip directly turns on the channel corresponding to the current local dimming area according to the mapping information, and drives the lamp beads in the current local dimming area.

In this embodiment, after generating a piece of local area dimming data, the timing control chip directly sends it to the backlight driving circuit, without waiting for all pieces of local area dimming data corresponding to one frame of display data to be collected before sending them to the backlight driving circuit, thus achieving the effect of reducing time. In addition, the timing control chip does not stop generating subsequent regional dimming data during the process of sending local area dimming data to the backlight driving circuit, thereby further reducing the process from receiving display data from the timing control chip to driving the lamp beads.

Figure 2:
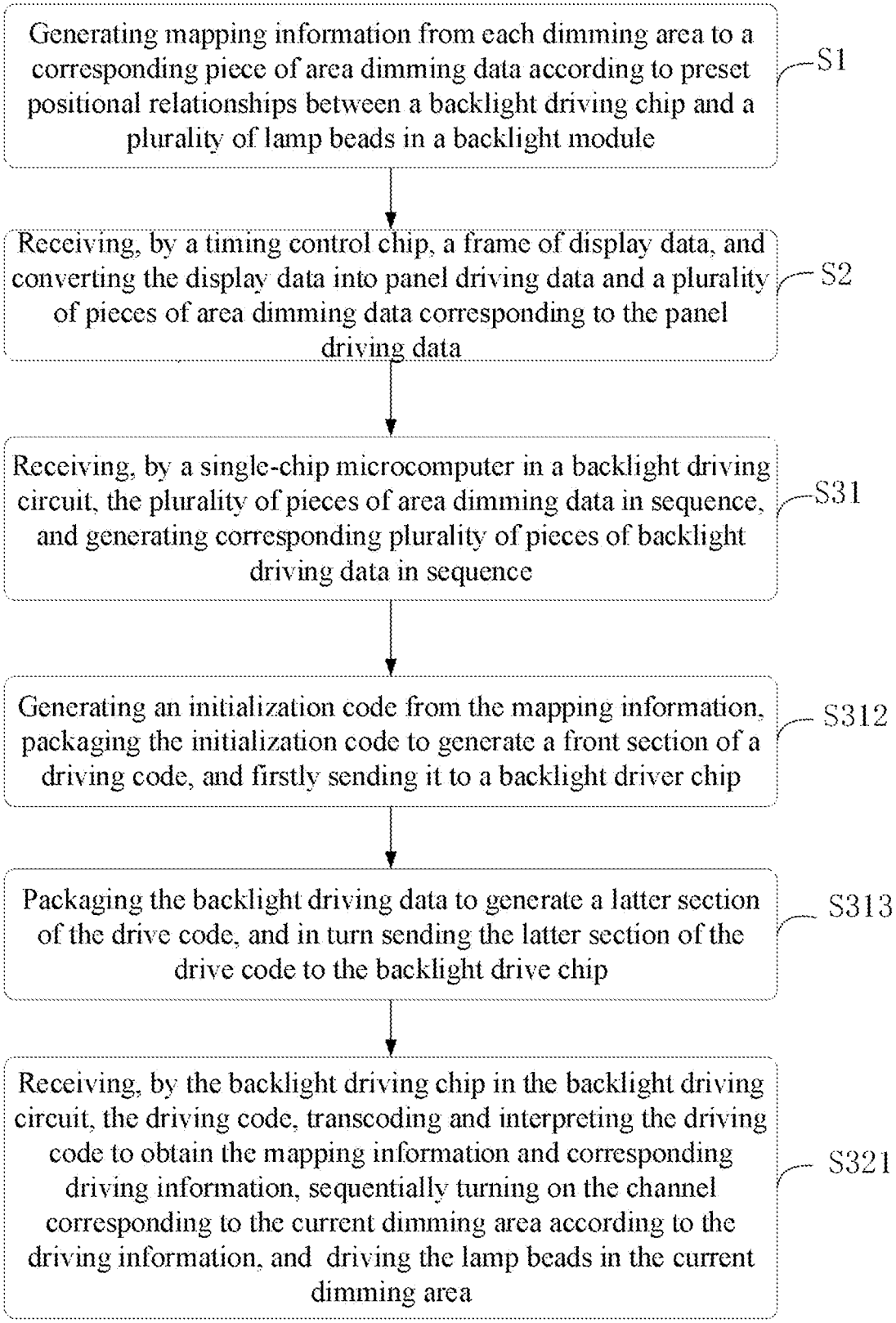
FIG. 2 is a flowchart illustrating another driving method of a backlight module provided by a first embodiment of the present application.

As illustrated in FIG. 2, operation S3 includes:

S31: receiving, by the single-chip microcomputer in the backlight driving circuit, the plurality of pieces of local area dimming data in sequence, and generating corresponding plurality of pieces of backlight driving data in sequence;

S32: receiving, by the backlight driving chip in the backlight driving circuit, a plurality of piece of backlight driving data in sequence, and according to the mapping information, sequentially turning on the channel corresponding to the current local dimming area, and driving the lamp beads in the current local dimming area.

Due to the high operation efficiency of a single chip microcomputer (MCU), the running speed of the backlight driving circuit can be accelerated by arranging the single chip microcomputer in the backlight driving circuit, and the time of backlight driving can be further shortened. Of course, the single-chip microcomputer may not be provided, and the timing control chip can directly convert the display data into backlight driving data, and then send it to the backlight driving chip.

In this embodiment, the mapping information is preferably sent to the backlight driver IC (LED Driver IC) in the form of codes. Correspondingly, in addition to the operation of the single-chip microcomputer receiving the plurality of pieces of local area dimming data in sequence and generating corresponding plurality of pieces of backlight driving data in sequence, the operation S31 further includes operation S311: the single-chip microcomputer packages the mapping information and the backlight driving data to generate a driving code, and sends it to the backlight driving chip. In operation S32, operation S321 is further included: the backlight driving chip in the backlight driving circuit receives the driving code, transcodes and interprets the driving code to obtain mapping information and corresponding driving information, and sequentially turns on turns on the channel corresponding to the current local dimming area according to the driving information, and drives the lamp beads in the current local dimming area.

Since the single-chip microcomputer and the backlight driving chip are connected by a pin, the backlight driving chip can only receive the data sent by the single-chip microcomputer one piece by one piece, and cannot receive multiple pieces of data at the same time. Therefore, by packaging the mapping information and the backlight driving data into a driving code and sending them to the backlight driving chip, the coherence between the mapping information and the backlight driving data can be improved, and the incompatibility between the mapping information and the backlight driving data can be prevented.

Further, in operation S311, the following operations are included:

S312: generating the initialization code from the mapping information, package the initialization code to generate the front section of the driving code, and send the front section of the driving code to the backlight driving chip first;

S313: packaging the backlight driving data to generate the latter section of the driving code, and sending it to the backlight driving chip in turn;

Correspondingly, in step S321, the backlight driving chip firstly receives the front section of the driving code, and then receives the latter section of the driving code.

By applying the mapping information to the front end of the backlight driving data, the backlight driving chip first receives the initialization code, and then receives the code corresponding to the backlight driving data, so that the corresponding lamps beads can be driven directly according to the backlight driving data based on the mapping relationships contained in the initialization code. In the process of successively receiving the initialization code and the code corresponding to the backlight driving data, the backlight driving chip will not waste time during the intermediate transition, and it can also ensure that all the backlight driving data corresponding to one frame of image can be sent to the backlight driving chip coherently and continuously, so that it will not affect the continuity effect of backlight driving.

Furthermore, in operation S311, the mapping information and the backlight driving data corresponding to each frame of display data are packaged to generate a driving code. Correspondingly, in step S313, the backlight driving data corresponding to one frame of display data are all packaged to generate the latter section of the driving code.

By assigning the display data in each frame to an initialization code, when the backlight driving chip receives the backlight driving data corresponding to each frame, it will remap according to the mapping relationship corresponding to this frame. Even if the mapping relationship corresponding to a certain frame is abnormal, it will not affect the normal display of other frames, which improves the fault tolerance rate in the driving process. Of course, an initialization code can also be disposed before the backlight driving data corresponding to each piece of local area dimming data, which can be achieved by packaging the backlight driving data corresponding to each piece of local area dimming data in the mapping information to generate the driving code, and then sending it to the backlight driving chip.

Embodiment 2

Figure 3:
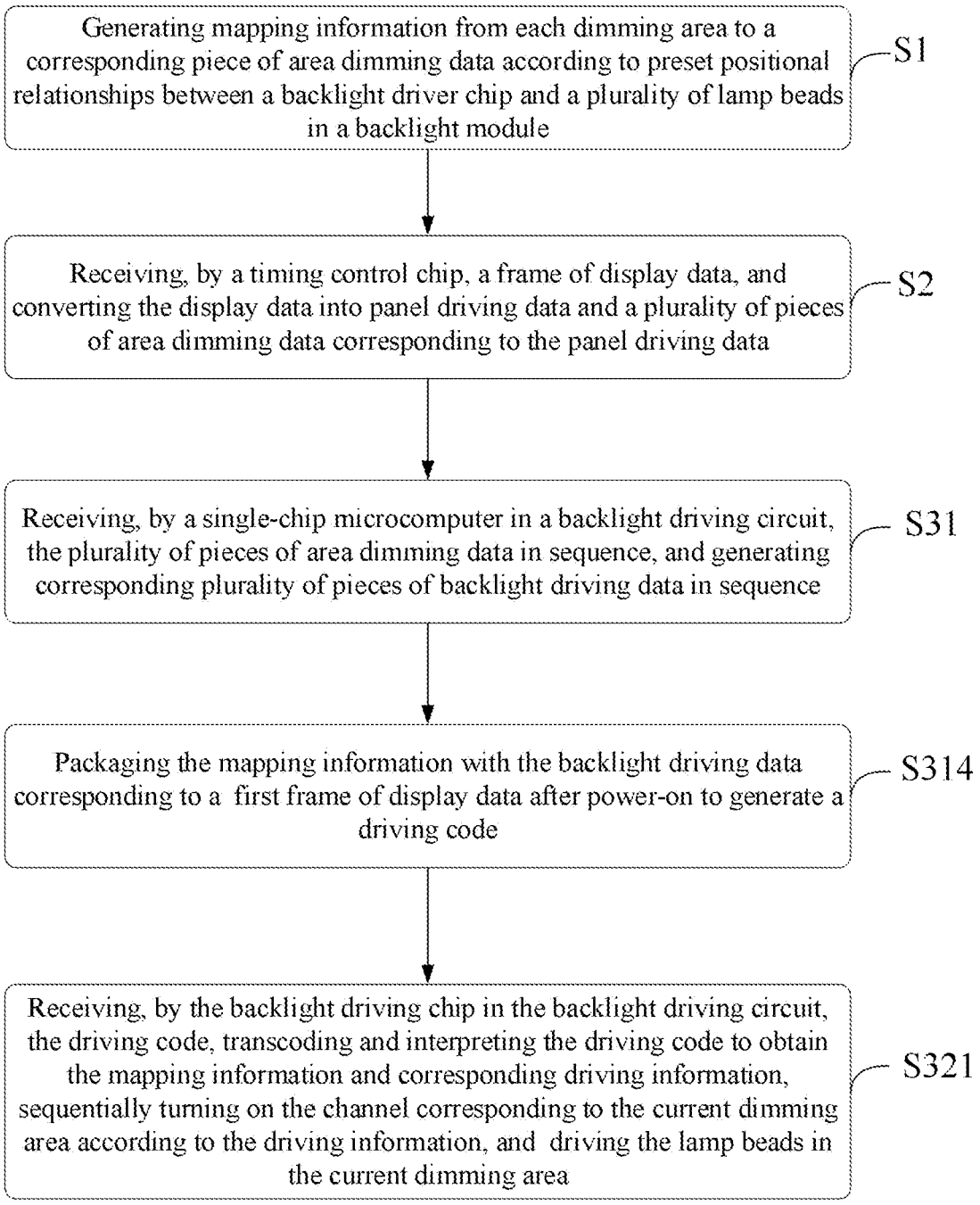
FIG. 3 is a flowchart illustrating a driving method of a backlight module provided by a second embodiment of the present application.

FIG. 3 is a flowchart illustrating a backlight module driving method provided by a second embodiment of the present application. The backlight module driving method includes the following operations:

- S1: generating the mapping information of a local dimming area to corresponding local area dimming data based on a preset positional relationship between a backlight driving chip and lamp beads in the backlight module;
- S2: receiving, by the timing control chip, a frame of display data, and converting the display data into panel driving data and corresponding multiple pieces of local area dimming data; and
- S31: receiving, by the single-chip microcomputer in the backlight driving circuit, the plurality of pieces of local area dimming data in sequence, and generating corresponding plurality of pieces of backlight driving data in sequence;
- S314: packaging the mapping information with the backlight driving data corresponding to the first frame of display data after power-on to generate the driving code.

S321 is further included: the backlight driving chip in the backlight driving circuit receives the driving code, transcodes and interprets the driving code to obtain mapping information and corresponding driving information, and sequentially turns on turns on the channel corresponding to the current local dimming area according to the driving information, and drives the lamp beads in the current local dimming area.

Different from the first embodiment, the mapping information is only packaged with the backlight driving data corresponding to the first frame of display data after power-on to generate the driving code.

Specifically, in this embodiment, only the display data of the first frame corresponds to an initialization code. That is, only after each boot, before sending the backlight driving data corresponding to the first frame of display data to the backlight driving chip, the single-chip microcomputer first converts the mapping information into initialization code and sends it to the backlight driving chip, and sequentially sends the backlight driver data corresponding to each subsequent frame of display data to the backlight driving chip in the form of code, and then the backlight driving chip turns on the channel corresponding to each local dimming area in turn according to the transcoded and decoded initialization code information, and drives the lamp beads in the local dimming area.

In this embodiment, the single-chip microcomputer only sends the initialization code to the backlight driving chip once during the process from power-on to power-off of the display device, that is, only the first piece of local area dimming data in the first frame of display data will be packaged with the initialization code and sent to the backlight driving chip, while the subsequent other pieces of local area dimming data will not be packaged with the initialization code. It is only necessary to directly send other subsequent pieces of local area dimming data to the backlight driving chip in the form of code or non-code, saving the time for transcoding the mapping information into initialization code many times and for packaging each frame of display data after the first frame of display data with the initialization code, which further improves the problem of backlight driving delay.

Of course, before the step S311, a step of reading the mapping information by the backlight driving circuit may also be included. In this case, the mapping information is not sent to the backlight driving chip in the form of initialization code, but is sent to the backlight driving chip as a separate program, and the backlight driving chip can directly read the mapping information, so that the mapping information does not need to be packaged with the backlight driver data to generate the driving code, and then sent to the backlight driving chip, thus saving the steps of transcoding, synthesizing and decoding the mapping information and the backlight driver information, and so the time of the backlight driving process can also be further shortened.

Embodiment 3

Figure 4:
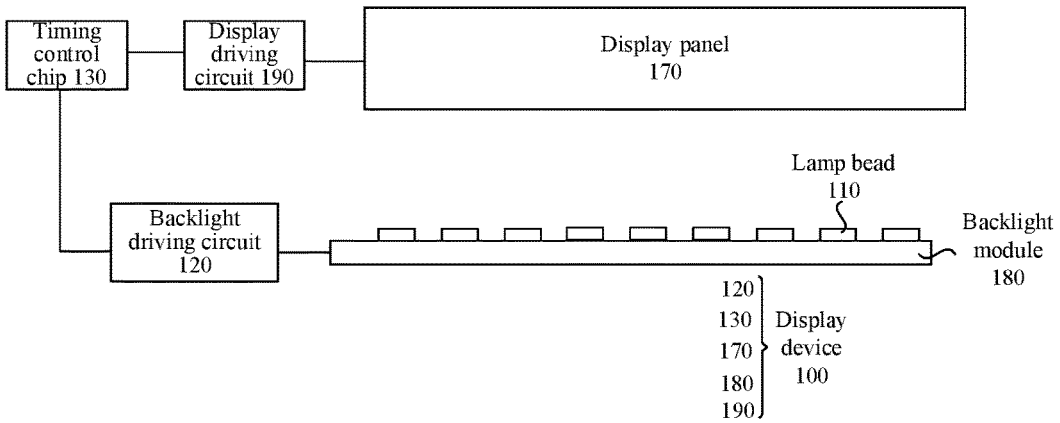
FIG. 4 is a schematic diagram of a display device provided by a third embodiment of the present application.

FIG. 4 is a schematic diagram of a display device provided by a third embodiment of the present application. The display device 100 includes a display panel 170, a backlight module 180, a timing control chip 130, a display driving circuit 190 and a backlight driving circuit 120. The backlight module 180 is disposed on a light incident surface of the display panel 170, and provides a backlight source for the display panel 170. One end of the display driving circuit 190 is connected to the timing control chip 130, and the other end is connected to the display panel 170 to drive the display panel 170. One end of the backlight driving circuit 120 is connected to the timing control chip 130, and the other end is connected to the backlight module 180 to control the lamp beads 110 in the backlight module 180 to emit light.

Figure 5:
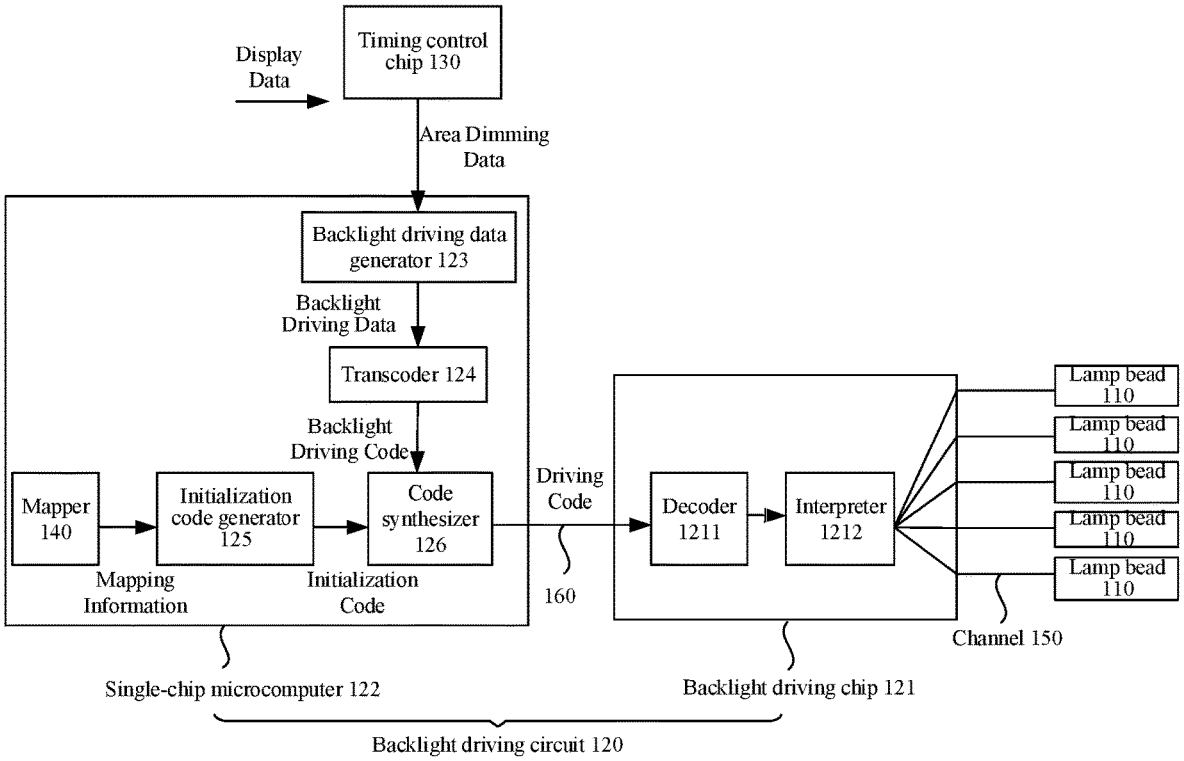
FIG. 5 is a schematic diagram of a driving process of a display device in the third embodiment of the present application.

With reference to FIG. 5, the display device 100 further includes a mapper 140, the plurality of lamp beads 110 in the backlight module 180 are divided into a plurality of local dimming areas, and the lamp beads in each local dimming area 110 is connected to the backlight driving circuit 120 through a channel 150, and the timing control chip 130 receives a frame of display data, and converts the display data into panel driving data and corresponding multiple pieces of local area dimming data. Each piece of local area dimming data is in one-to-one correspondence with each local dimming area. The mapper 140 is disposed in the backlight driving circuit 120, and according to the preset positional relationships between the backlight driving chip 121 and the lamp beads 110, generates mapping information for the local dimming areas to the corresponding local area dimming data. The backlight driving circuit 120 receives the plurality of local area dimming data in sequence, and turns on the channel 150 corresponding to the current local dimming area in turn according to the mapping information recorded in the mapper 140 to drive the lamp beads 110 in the current local dimming area.

With the display device 100 provided in this embodiment, when the backlight driving circuit 120 receives the local area dimming data, it will drive the lamp beads 110 corresponding to the local dimming area according to the mapping information through the mapper 140, thereby eliminating the need for adding an adjustment module to rearranging the local area dimming data, the time for driving the lamp beads 110 is saved, and the delay time between the backlight driving of the backlight module and the display driving of the panel in the display device 100 is reduced, and the display effect of the display device 100 is improved.

Specifically, the backlight driving circuit 120 includes a backlight driving chip 121 and a single-chip microcomputer 122. The single-chip microcomputer 122 is connected to the backlight driving chip 121 through a pin 160 and provides backlight driving data for the backlight driving chip 121. The single-chip microcomputer 122 includes a backlight driving data generator 123, a transcoder 124, an initialization code generator 125 and a code synthesizer 126. The backlight driving data generator 123 receives the local area dimming data and converts the local area dimming data to backlight driving data. The transcoder 124 converts the backlight driving data into a backlight driving code. The initialization code generator 125 is connected with the mapper 140 to convert the mapping information into an initialization code.

The initialization code generator 125 is connected with the mapper 140, converts the mapping information into the initialization code. The code synthesizer 126 is connected with each of the transcoder 124, the initialization code generator 125 and the backlight driving chip 121, receives the backlight driving code and the initialization code, synthesizes the backlight driving code and the initialization code into a driving code, and sends the driving code to the backlight driving chip 121. The backlight driving chip 121 includes a decoder 1211 and an interpreter 1212. The decoder 1211 receives the driving code and decodes the driving code. The interpreter 1212 is connected to the decoder 1211, and turns on the channel 150 corresponding to the current local dimming area according to the decoded information, and drives the lamp beads 110 in the current local dimming area.

The mapper 140 can be arranged in the single-chip microcomputer 122 or in the backlight driving chip 121, and the mapping information only needs to be pre-written into the memory of the corresponding structure.

It should be noted that the description of various steps involved in this solution are not to be construed as limiting the order of steps, if the implementation of the specific solution is not affected. That is, the steps written in earlier can be performed before, or after, or even at the same time as those written later. As long as this solution can be implemented, any order of the steps should be regarded as falling in the scope of protection of this application.

It should be noted that the inventive concept of the present application can form a large number of embodiments, but they cannot be enumerated because the length of the application document is limited. The technical features as set forth herein can be arbitrarily combined to form a new embodiment, and the original technical effects may be enhanced after various embodiments or technical features are combined.

The technical solutions of the present application may be widely used in various display panels, such as TN (Twisted Nematic) display panels, IPS (In-Plane Switching) display panels, VA (Vertical Alignment) display panels, and MVA (Multi-Domain Vertical Alignment) display panels.

The foregoing is a further detailed description of the present application in conjunction with specific optional embodiments, but it should not be construed as that the specific implementation of the present application will be limited to these descriptions. For those having ordinary skill in the technical field of the present application, without departing from the scope and spirit of the present application, some simple deductions or substitutions can be made, which should all be regarded as falling in the scope of protection of the present application.

What is claimed is:

1. A driving method of a backlight module, comprising:

generating mapping information from each local dimming area to a corresponding piece of local area dimming data according to preset positional relationships between a backlight driving chip and a plurality of lamp beads in the backlight module;

receiving, by a timing control chip, a frame of display data, and converting the display data into a plurality of pieces of panel driving data and a plurality of pieces of local area dimming data corresponding to the plurality of pieces of panel driving data; and receiving, by a backlight driving circuit, the plurality of pieces of local area dimming data in sequence, and sequentially turning on a channel corresponding to a current local dimming area according to the mapping information, and driving lamp beads in the current local dimming area;

wherein the operations of receiving, by a backlight driving circuit, the plurality of pieces of local area dimming data in sequence, and sequentially turning on a channel corresponding to a current local dimming area according to the mapping information, and driving the lamp beads in the current local dimming area comprise:

receiving, by a single-chip microcomputer in the backlight driving circuit, the plurality of pieces of local area dimming data in sequence, and generating corresponding plurality of pieces a backlight driving data in sequence; and receiving, by the backlight driving chip in the backlight driving circuit, the plurality of pieces of backlight driving data in sequence, and sequentially turning on the channel corresponding to the current local dimming area according to the mapping information, and driving the lamp beads in the current local dimming area.

2. The driving method of claim 1, wherein in the operation of receiving, by a timing control chip, a frame of display data, and converting the display data into a plurality of pieces of panel driving data and a plurality of pieces of local area dimming data corresponding to the plurality of pieces of panel driving data, the timing control chip is configured to directly send a current piece of local area dimming data after generating the piece of local area dimming data and then proceeds to generate a next piece of local area dimming data;

and wherein in the operation of receiving, by a backlight driving circuit, the plurality of pieces of local area dimming data in sequence, and sequentially turning on a channel corresponding to a current local dimming area according to the mapping information, and driving the lamp beads in the current local dimming area, the backlight driving chip is configured to directly turn on the channel corresponding to the current local dimming area according to the mapping information to drive the lamp beads in the current local dimming area.

3. The driving method of claim 1, wherein in the operation of receiving, by a single-chip microcomputer in the backlight driving circuit, the plurality of pieces of local area dimming data in sequence, and generating corresponding plurality of pieces of backlight driving data in sequence, there is further comprised the operation of: packaging, by the single-chip microcomputer, the mapping information and the backlight driving data to generate a driving code, and sending the driving code to the backlight driving chip;

and wherein in the operation of the receiving, by the backlight driving chip in the backlight driving circuit, the plurality of pieces of backlight driving data in sequence, and sequentially turning on the channel corresponding to the current local dimming area according to the mapping information, and driving the lamp beads in the current local dimming area, there is further comprised the operation of: receiving, by the backlight driving chip in the backlight driving circuit, the driving code, transcoding and interpreting the driving code to obtain mapping information and corresponding driving information, and sequentially turning on the channel corresponding to the current local dimming area according to the driving information, and driving the lamp beads in the current local dimming area.

4. The driving method of claim 3, wherein the operation of packaging, by the single-chip microcomputer, the mapping information and the backlight driving data to generate a driving code, and sending the driving code to the backlight driving chip comprises:

generating an initialization code from the mapping information, packaging the initialization code to generate a front section of the driving code, and firstly sending the front section of the driving code to the backlight driving chip; and packaging the backlight driving data to generate a latter section of the driving code, and in turn sending the latter section of the driving code to the backlight driving chip;

wherein in the operation of receiving, by the backlight driving chip in the backlight driving circuit, the driving code, transcoding and interpreting the driving code to obtain mapping information and corresponding driving information, and sequentially turning on the channel corresponding to the current local dimming area according to the driving information, and driving the lamp beads in the current local dimming area, the backlight driving chip first receives the front section of the driving code and then receives the latter section of the driving code.

5. The driving method of claim 4, wherein in the operation of packaging, by the single-chip microcomputer, the mapping information and the backlight driving data to generate a driving code, and sending the driving code to the backlight driving chip, the mapping information and the backlight driving data corresponding to each frame of display data are packaged to generate the driving code;

wherein in the operation of packaging the backlight driving data to generate the latter section of the driving code and sequentially sending the driving code to the backlight driving chip, the backlight driving data corresponding to one frame of display data is all packaged to generate the latter section of the driving code.

6. The driving method of claim 4, wherein one initialization code is arranged in front of each piece of backlight driving data corresponding to each piece of local area dimming data.

7. The driving method of claim 3, wherein in the operation of packaging, by the single-chip microcomputer, the mapping information and the backlight driving data to generate a driving code, and sending the driving code to the backlight driving chip, the mapping information is only packaged with the backlight driving data corresponding to a first frame of display data after power-on to generate the driving code.

8. The driving method of claim 1, further comprising the following operation prior to the operation of after the power is turned on, receiving, by a timing control chip, a frame of display data, and converting the display data into panel driving data and a corresponding plurality of pieces of local area dimming data:

reading, by the backlight driving circuit, the mapping information.

9. The driving method of claim 1, wherein the backlight module is a mini LED backlight module.

10. The driving method of claim 1, wherein the mapping information comprises a chart form, a code form, and a program form.

11. The driving method of claim 1, wherein the local dimming area is an area of the display screen with a same brightness, or an area corresponding to one pixel, or an area corresponding to one lamp bead.

12. A driving method of a backlight module, comprising:

generating mapping information from each local dimming area to a corresponding piece of local area dimming data according to preset positional relationships between a backlight driving chip and a plurality of lamp beads in the backlight module;

receiving, by a timing control chip, a frame of display data, and converting the display data into a plurality of pieces of panel driving data and a plurality of pieces of local area dimming data corresponding to the plurality of pieces of panel driving data;

receiving, by a backlight driving circuit, the plurality of pieces of local area dimming data in sequence, and sequentially turning on a channel corresponding to a current local dimming area according to the mapping information, and driving the lamp beads in the current local dimming area;

wherein the operation of receiving, by a backlight driving circuit, the plurality of pieces of local area dimming data in sequence, and sequentially turning on a channel corresponding to a current local dimming area according to the mapping information, and driving the lamp beads in the current local dimming area comprises:

receiving, by a single-chip microcomputer in the backlight driving circuit, the plurality of pieces of local area dimming data in sequence, and generating corresponding plurality of pieces of backlight driving data in sequence; and packaging the mapping information and the backlight driving data corresponding to a first frame of display data after power-on to generate a driving code;

receiving, by the backlight driving chip in the backlight driving circuit, the driving code, transcoding and interpreting the driving code to obtain mapping information and corresponding driving information, and sequentially turning on the channel corresponding to the current local dimming area according to the driving information, and driving the lamp beads in the current local dimming area.

13. The driving method of claim 12, wherein in the operation of receiving, by a single-chip microcomputer in the backlight driving circuit, the plurality of pieces of local area dimming data in sequence, and generating corresponding plurality of pieces of backlight driving data in sequence, there is further included the operation of:

packaging, by the single-chip microcomputer, the mapping information and the backlight drive data to generate the driving code, and sending the driving code to the backlight driving chip.

14. The driving method of claim 13, further comprising the following operation prior to the operation of packaging, by the single-chip microcomputer, the mapping information and the backlight drive data to generate the driving code, and sending it to the backlight driving chip:

reading, by the backlight driving circuit, the mapping information.

15. A display device, comprising:

a plurality of lamp beads, divided into a plurality of local dimming areas;

a backlight driving circuit, wherein the lamp beads in each local dimming area are connected to the backlight driving circuit through a channel;

a timing control chip, configured to receive a frame of display data and convert the display data into a plurality of pieces of panel driving data and a plurality of pieces of local area dimming data corresponding to the plurality of pieces of panel driving data; wherein each piece of local area dimming data is in one-to-one correspondence with each local dimming area;

a mapper, arranged in the backlight driving circuit, and configured to generate mapping information from each local dimming area to the corresponding piece of local area dimming data according to preset positional relationships between a backlight driving chip and the plurality of lamp beads;

wherein the backlight driving circuit is configured to receive the plurality of pieces of local area dimming data in sequence, and sequentially turn on the channel corresponding to the current local dimming area according to the mapping information recorded in the mapper, and drive the lamp beads in a current local dimming area;

wherein the backlight driving circuit comprises a backlight driving chip and a single-chip microcomputer, wherein the single-chip microcomputer is connected to the backlight driving chip through a pin, and is configured to provide backlight driving data for the backlight driving chip;

wherein the single-chip microcomputer comprises a backlight driving data generator, a transcoder, an initialization code generator, and a code synthesizer, wherein the backlight driving data generator is configured to receive a piece of local area dimming data and convert the piece of local area dimming data into a piece of backlight driving data; the transcoder is configured to convert the piece of backlight driving data into a backlight driving code;

the initialization code generator is connected to the mapper, and configured to convert the mapping information into an initialization code; the code synthesizer is connected to each of the transcoder, the initialization code generator, and the backlight driving chip, and configured to receive the backlight driving code and the initialization code, synthesize the backlight driving code and the initialization code into a driving code, and send the driving code to the backlight driving chip;

the backlight driving chip comprises a decoder and an interpreter, wherein the decoder is configured to receive the driving code and decode the driving code, the interpreter is connected with the decoder and is configured to turn on the channel corresponding to the current local dimming area according to the decoded information, and drive the lamp beads in the current local dimming area.

16. The display device of claim 15, wherein the mapper is disposed in the single-chip microcomputer or the backlight driving chip.

* * * * *